US010000946B2

(12) United States Patent
Niegeloh et al.

(10) Patent No.: US 10,000,946 B2
(45) Date of Patent: Jun. 19, 2018

(54) ARRESTING ELEMENT AND HANDLE

(71) Applicant: Huf Hülsbeck & Fürst GmbH & Co. KG, Velbert (DE)

(72) Inventors: Andreas Niegeloh, Solingen (DE); Markus Bartels, Mülheim (DE)

(73) Assignee: Huf Hülsbeck & Fürst GmbH & Co. KG, Velbert (DE)

( * ) Notice: Subject to any disclaimer, the term of this patent is extended or adjusted under 35 U.S.C. 154(b) by 159 days.

(21) Appl. No.: 14/872,318

(22) Filed: Oct. 1, 2015

(65) Prior Publication Data

US 2016/0097222 A1 Apr. 7, 2016

(30) Foreign Application Priority Data

Oct. 2, 2014 (DE) ..... 10 2014 114 378

(51) Int. Cl.

| | |
|---|---|
| ***E05B 3/00*** | (2006.01) |
| ***E05B 77/06*** | (2014.01) |
| ***E05B 77/04*** | (2014.01) |
| ***E05B 85/10*** | (2014.01) |

(52) U.S. Cl.

CPC ..... *E05B 77/06* (2013.01); *E05B 77/04* (2013.01); *E05B 85/10* (2013.01)

(58) Field of Classification Search

CPC ..... Y10S 292/22; E05B 77/02; E05B 77/04; E05B 77/06

See application file for complete search history.

(56) References Cited

U.S. PATENT DOCUMENTS

| | | | | |
|---|---|---|---|---|
| 9,567,777 | B1 * | 2/2017 | VandenBrink | E05B 77/06 |
| 9,695,614 | B2 * | 7/2017 | Jeong | E05B 1/0038 |
| 2005/0012345 | A1 | 1/2005 | Saitoh | |
| 2008/0136199 | A1 * | 6/2008 | Kim | E05B 77/06 292/340 |
| 2012/0074718 | A1 * | 3/2012 | Nagata | E05B 77/06 292/336.3 |
| 2014/0306486 | A1 * | 10/2014 | Nam | E05B 77/06 296/187.12 |
| 2014/0354007 | A1 * | 12/2014 | Ogawa | E05B 77/06 296/146.2 |
| 2015/0054295 | A1 * | 2/2015 | Nam | E05B 77/06 292/336.3 |
| 2015/0069764 | A1 * | 3/2015 | Kerr, III | E05B 77/06 292/139 |

(Continued)

FOREIGN PATENT DOCUMENTS

| | | |
|---|---|---|
| DE | 102008062214 | 7/2010 |
| DE | 102009056538 | 6/2011 |

(Continued)

OTHER PUBLICATIONS

European Search Report and the European Search Opinion dated Feb. 16, 2016 From the European Patent Office Re. Application No. 15186737.1 and Its Translation Into English.

*Primary Examiner* — Matthew W Ing

(57) ABSTRACT

An arresting element for a blocking element of a locking device of a vehicle door, with a fixing area for fixing the arresting element at the locking device, a sensor area for detecting a deformation of a door panel of the vehicle, particularly an inner door panel, which is directed towards the interior of the vehicle, and an arresting area for arresting the blocking element.

14 Claims, 4 Drawing Sheets

(56) References Cited

U.S. PATENT DOCUMENTS

| | | | | |
|---|---|---|---|---|
| 2015/0191942 | A1* | 7/2015 | Ilardo | E05B 77/06 292/336.3 |
| 2016/0108646 | A1* | 4/2016 | Kim | E05B 79/20 292/336.3 |

FOREIGN PATENT DOCUMENTS

| | | | | |
|---|---|---|---|---|
| EP | 2342406 | | 7/2011 | |
| WO | WO 2010/049311 | | 5/2010 | |
| WO | WO-2010049311 | A1 * | 5/2010 | E05B 77/04 |

* cited by examiner

ARRESTING ELEMENT AND HANDLE

RELATED APPLICATION

This application claims the benefit of priority of German Patent Application No. 10 2014 114 378.7 filed Oct. 2, 2014, the contents of which are incorporated herein by reference in their entirety.

FIELD AND BACKGROUND OF THE INVENTION

The invention relates to an arresting element for a blocking element of a locking device according to the preamble of claim 1 and handle for the locking device of a vehicle door according to the preamble of claim 5. Thereby, the handle comprises a mass balancing element, which can be brought in an operative connection with the door handle, wherein the mass balancing element in consequence of an influence of accelerations, which act on a door handle during an accident, avoid an unintended opening of the door due to its mass inertia and a blocking element, which is movable between a resting position and a locking position, wherein in the resting position the mass balancing element is movable relative towards the blocking element and in the blocking position, in which the blocking element is deflected during an accident due to its mass inertia, the blocking element blocks the mass balancing element.

It is known that handles are assembled in locking devices at vehicle doors, which are also called crash-locks, which should avoid that the vehicle door is opened unintendedly in case of an accident. Therefor the known handles comprise mass balancing elements, which are used for securing door handles due to their mass inertia.

A generic state of the art is for example known from document DE 10 2009 056 538 A1. Hereby a crash-lock is intended in a locking device of a vehicle door, which comprises a transmission element, a mass balancing element and a blocking element. The door handle and the mass balancing element are thereby pivotably mounted and are connected via the transmission element in a manner of a rocker with one another in a way that the transmission element can transfer the tensile force at the door handle in an unlocking direction, which opens the door lock to the mass balancing element contrary to its inertia force. Since the mass balancing element is configured more massive than the door handle therewith the door handle has to be pulled with a sufficient force in order to move the mass balancing element and to open the door. The blocking element is likewise pivotably mounted. However, it is not operated during normal operation and is in its resting position. However, it can be swiveled into the same direction of rotation like the door handle due to its mass inertia, when the door handle is turned into the unlocking position so that the blocking element is transferred to a blocking position regarding the mass balancing element, in which the blocking element blocks the mass balancing element.

During an accident impact forces and accelerations can have an effect on the vehicle door, which can lead to the fact that the door handle is skidded into the unlocking direction, which opens the door lock. The mass balancing element, which is accelerated in the same direction, normally ensures that the door handle remains in its locking position. If however during the accident the door panel, particularly the outer door panel, is damaged, the mass balancing element can however be pushed into its released position, in which the unintended opening of the door cannot be avoided. The locking element of document DE 10 2009 056 538 A1 can thereby be transferred in its blocking position by deformation of the outer door panel in order to block the mass balancing element.

During an intensive lateral impact on the vehicle and a deflection of the vehicle door it can however occur that not only the outer door panel can be deformed heavily but also the inner door panel, which is directed to the interior space of the vehicle. In the door panel so called "waves" are configured. Thereby, the disadvantage has occurred that by this deformation the door handle can be already transferred in its unlocking position opening the door lock despite of the mass balancing element and the blocking element. Hereby, the mass balancing element can be pushed into the direction enabling the opening of the door. At the same time it can occur that the blocking element is clamped and cannot be released functionally anymore and cannot lock the mass balancing element anymore. As a consequence the vehicle door can be opened, wherein an increased risk of injury for the person sitting within the vehicle occurs.

SUMMARY OF THE INVENTION

Therefore it is the object of the present invention to provide a handle of the before mentioned manner by which said disadvantages can be at least partially avoided. Particularly, it is the object of the present invention to provide a handle, which is configured simply and comprises a good functionality, wherein with an intensive lateral vehicle impact and/or during deformation of the vehicle door an opening of the door is reliably avoided. Further, the object of the present invention should be solved by a corresponding arresting element.

For the solution of this objection an arresting element for a blocking element of a locking device with the features of claim 1 and a handle for the locking device of a vehicle door with the features of claim 5 is proposed. Thereby, the technical features, which are disclosed for the device according to the invention, apply also for the method according to the invention and vice versa, so that according to this it can be mutually referred to. In the dependent claims appropriate embodiments are described.

Therefore, according to the invention, an arresting element for the blocking element of a locking device of a vehicle is intended, which is configured with the fixing area for fixing the arresting element at the locking device, a sensor area for detecting a deformation of a door panel of the vehicle, particularly of an inner door panel, which is directed towards the interior of the vehicle and an arresting area for arresting the blocking element. The idea of the invention is that an arresting element is provided, which can be refitted to an existing locking device without altering the geometry of the locking device. Therefor advantageously the arresting area is intended, which can be configured in a way in order to assemble the arresting element in an existing locking device, without having to reconstruct the locking device. The arresting element according to the invention should be able to advantageously register the deformation of the door in an early stage, particularly the inner door panel, in order to arrest the blocking element in its blocking position in time, so that the blocking element can reliably release and the mass balancing element can be securely block. Therefor advantageously a sensor area is intended, which is configured in a way to recognize the deformation of the inner door panel. The advantage of the invention is at the same time, that the sensor area can be configured in a way that the arresting element can be transferred from a released position to an arresting position only by deformation of the door panel, particularly the inner door panel. Thereby, in the released position of the arresting element the blocking element can remain movable relative to the arresting element, whereas in the arresting position of the arresting element the arresting element can arrest the blocking element. A particular advantage of the invention is further that the arresting element itself without further components and modifications of the locking device serves that the blocking element reliably fulfils its function and that in case of an accident the blocking element always remains in its blocking position or is transferred to its blocking position. Therefor the arresting element according to the invention comprises an averbinderesting area, which can reliably keep the blocking element in its blocking position, particularly can be pushed into the blocking position in case the door panel is deformed.

According to an advantage of the invention the fixing area can comprise a fixing means, particularly in form of a step of a clip, catch, snap or hinge means in order to arrest the arresting element in a form and/or force-fitting manner particularly detachably at a mounting element of the locking device. Thereby, it is advantageous that any type of a detachable fixation can be used in order to arrest the arresting element at an existing locking device, which matches the respective locking device in order to adjust the arresting element to the existing circumstances. It is further advantageous that by a suitable arresting means the arresting elements can be assembled at the mounting element exactly where space is provided and the arresting element can arrest the blocking element. Alternatively, it is however possible that the fixing means can be an adhesive in order to firmly bind the arresting element to the mounting element. Further, it is possible that the fixing area of the arresting element is welded at the mounting element, wherein particularly the fixing means is configured in form of a welding seam. Further, different detachable and durable connections are possible, which further allow that the arresting element is assembled at the mounting element in a pivoted and/or tiltable and/or resilient manner in order to ensure that the arresting element can be movable at least between the released position and the blocking position according to the blocking element.

Further, the sensor area according to the invention can comprise a sensor means particularly in form of a curved element, which can bend into the direction towards the inner door panel of the vehicle following the assembly of the arresting element at the locking device in order to detect a deformation of the inner door panel by contact. Advantageously, thereby the deformation of the door panel can be transmitted directly to the arresting element, wherein the sensor means can at the same time serve for the fact that the arresting element is pushed into the arresting position.

Further, the arresting area according to the invention can comprise an arresting means particularly in form of a striking area, which can be in an operative connection during the deformation of the inner door panel with a complementary arresting area of the blocking element in order to arrest the blocking element. Advantageously, the arresting area can be configured broadened in order to flatly fit closely to the arresting area of the blocking element and the blocking element is therewith pushed into the blocking position. The sensor means can thereby advantageously implement the mechanic deformation energy of the inner door panel into a movement of the arresting elements from the released position in the arresting position and/or can transfer it directly to the arresting means, which can perform a mechanic pressure to the blocking element in the blocking position in a way that the blocking element cannot be re-deflected in its resting position.

Further, the object according to the invention is solved by a handle for a locking device of a vehicle door with the features of claim 5 with a mass balancing element, which can be brought into an operative connecting with the door handle, wherein the mass balancing element can avoid an undesired opening of the door due to its mass inertia followed by an influence of accelerations, which act on the door handle during an accident, a blocking element can be configured, which can be moved between a resting position and a blocking position, wherein in the resting position the mass balancing element can be movable relative to the blocking element and in the blocking position, in which the blocking element can be deflected due to its mass inertia during an accident, the blocking element can block the mass balancing element. Therefor it is intended according to the invention that the handle can provide an arresting element, particularly as previously described, which can be moved between a released position and an arresting position, wherein in the released position the blocking element can be movable relative towards the arresting element and in the arresting position the arresting element can arrest the blocking element. Advantageously, an additional security can be provided that no undesired opening of the door occurs in case the blocking element is jammed and/or is disturbed in its function by deformation of the door panel particularly of the outer door panel, which is directed towards the outside. The arresting element thereby advantageously serves for the fact that when the equilibrium of forces between the mass of the locking device is disturbed by mechanic deformation of the door panel the door can remain closed. Thereby, the arresting element can be activated especially by the deformation of the door panel, particularly the inner door panel, in order to push the blocking element back in its blocking position so that the mass balancing element remains reliably closed.

According to the invention the handle can comprise a mounting element at which the locking device can be assembled and at which the blocking element and the mass balancing element can be movably assembled. In and at the mounting element advantageously diverse components of the handle can be received like for example the arresting element, a closing cylinder or such like. Further, the mounting element can comprise areas and sections, which can serve for the assembly of the locking device at the door panel. Further, the mounting element can advantageously comprise protective walls and/or lateral areas, which can protect said components of the handle from eventual lateral influences during a possible accident.

According to the invention the handle can be assembled between the outer door panel, at which the door handle can be assembled, and an inner door panel, which is directed towards the interior of the vehicle. Hereby it is important that during an accident when one of the door panels or both can be deformed the handle can provide security for the passengers, particularly can serve for the fact that the door is not opened undesirably. The handle according to the invention is thereby advantageously configured in a way and assembled between the door panels in a way that even in case of a deformation of the door the handle cannot be swiveled for opening the door undesirably. According to the invention the deformation of the door panel can be used particularly in case that both door panels are deformed in "waves" in order to control the arresting element, which can arrest the blocking element, which in turn can block the mass balancing element, which than blocks the opening of the door.

Therefore, it can be intended according to the invention that the arresting element can be transferred in the arresting position during an accident by deformation of a door panel, particularly an inner door panel, which is directed toward the interior of the vehicle. According to the invention the door panel can directly contact the arresting element during an accident and can actuate the arresting element, wherein the arresting element can be pushed from its released position in the arresting position in order to transfer the blocking element from the deflected position back into the blocking position. It is thereby advantageous that a secure functional manner of the blocking element can be securely ensured with a deformed door. Hits for example a car in this door and deforms the door, the blocking element can be deflected from its resting position, wherein however the arresting element uses the compressive force at the bended vehicle door in order to push the blocking element back in the blocking position. Thereby, the blocking element can be act together with the mass balancing element in a way that the mass balancing element cannot be moved in a released position, in which the door lock can be opened, wherein an undesired opening of the door is avoided.

The idea of the invention can further intend that the arresting element can be assembled at the mounting element in a form and/or force fitting and/or firmly bonded manner in order to advantageously upgrade the existing locking device. At the same time it is possible that the arresting element can be assembled detachably or permanently at the locking device. Therewith, it can be advantageously ensured that the arresting element can be flexibly adjusted to the existing geometries and characteristics.

According to the invention the mass balancing element can comprise an operating lever, with which the locking device, particularly the door handle, can be in connection. Advantageously, thereby the mass balancing element and the operating lever can be firmly connected to one another. Additionally, it is possible that the mass balancing element and the operating lever can be configured monolithic, material uniform and/or in form of a component. Further, a transfer element can be provided in order to transmit the tensile force at the door handle to the mass balancing element. The operating lever and the transfer element can therefore serve for the fact that between the door handle and the mass balancing element a kind of a rocker results, which in the normal case is used for opening the door and during accelerations and in case of a crash serves for the fact that the mass inertia of the mass balancing element avoids a tilting of the rocker and therewith the deflection of the door handle into the released position.

A further advantage of the present invention is that the mass balancing element is spring afflicted, particularly in an arresting position securing the door handle, and/or is pivotably mounted about an axis. Thereby, the handle can be stabilised by existing accelerations by the supporting effect of a spring element, for example a rotational, pressure or coil spring. During a vehicle impact due to an accident the mass balancing element can be moved about the axis, which is closing the door into the blocking position by itself due to its mass inertia. With a not further acting vehicle impact the mass balancing element due to the spring effect can reach a releasing unlocking position through swiveling, in which the door can be opened again. During accelerations due to an accident the blocking element can move into the blocking position, in which the mass balancing element is securely kept, in which the door handle is blocked in an unlocking position opening the door lock towards a displacement of the mass balancing element.

Advantageously, the blocking element can be spring afflicted, particularly in the released position and/or can rest pivotably about an axis. For example a spring element can serve for balancing of swinging movements of the blocking element in order to stabilize the handle during accident related accelerations, wherein particularly the spring element for example can be a rotational, pressure or coil spring or such like. During a vehicle impact related to an accident the blocking element can be automatically swiveled about the axis into the blocking position due to the mass inertia. With a not further acting vehicle impact the blocking element can be re-swiveled into the resting position due to the spring effect. During vehicle related accelerations the blocking element can be moved into the blocking position in which the mass balancing element is blocked in the locking position. During an accident related deformation of the door the arresting element effects according to the invention that the blocking element is reliably kept in the blocking position or is transferred to the blocking position.

With the invention further the axis of the mass balancing element can be assembled spaced or parallel to the axis of the blocking element. Further, it is advantageous that the mass balancing element and the blocking element can be pivotably rest at the mounting element that they can be movable in the same rotation direction during accelerations. Therewith, it can be ensured that the pivotable movement of the mass balancing element from the unlocking position in the locking position can occur parallel and undisturbed from the movable movements of the blocking element from the resting position into the blocking position. These movement patterns can avoid by a parallel assembly of the axis that the accelerations, which act to the door handle towards the door opening released position, are reliably retained. With an opposed accelerations, which act on the door handle in the door closing locking position, the mass balancing element can be re-swiveled undisturbedly in its unlocking position and the blocking element can be re-swiveled undisturbedly in its resting position.

Further, the blocking element according to the invention can comprise blocking means, which can be in operative connection in the blocking position of the blocking element with a complementary cam of the mass balancing element in order to block the mass balancing element. Consequently, the advantage can be achieved that in the blocking position of the blocking element a secure hold for the mass balancing element is provided, wherein the blocking means can press against the cam in a way that the mass balancing element cannot be swiveled in the unlocking position undesirably.

BRIEF DESCRIPTION OF THE SEVERAL VIEWS OF THE DRAWINGS

Further advantages, features and details of the invention result from the subsequent description. In relation to the drawings an embodiment of the invention is described in detail. Thereby, the features described in the claims and in the description can be essential for the invention each single for themselves or in any combination. It is shown:

DESCRIPTION OF SPECIFIC EMBODIMENTS OF THE INVENTION

Figure 1:
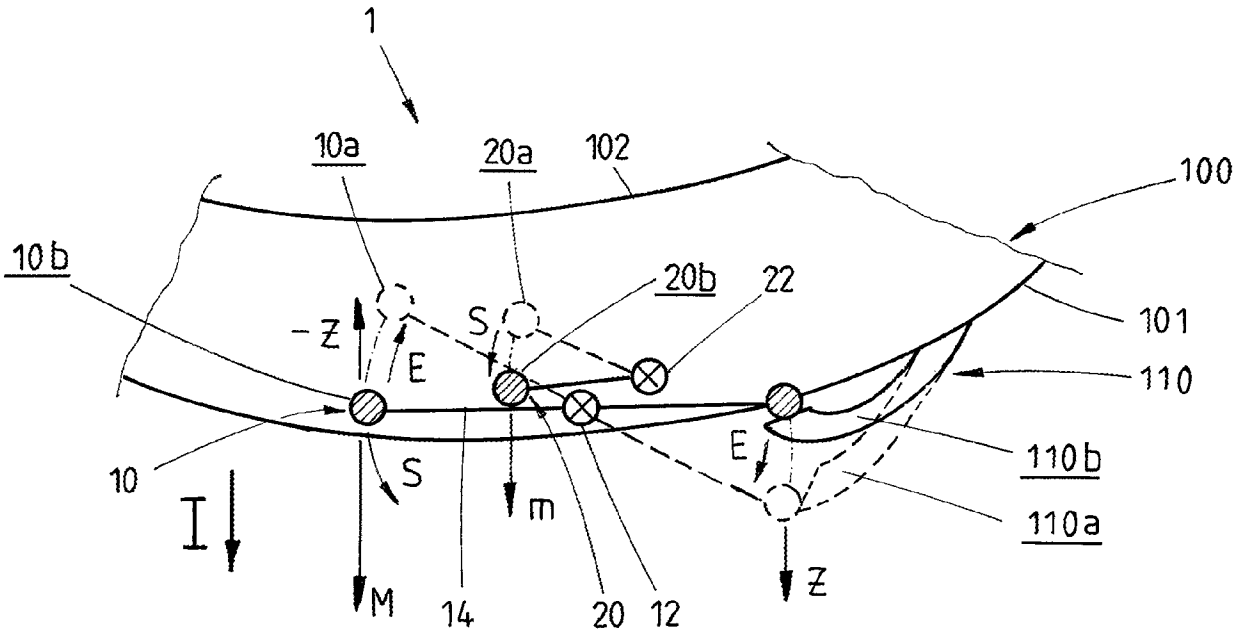
FIG. 1 a schematic sectional view of a handle for a locking device of a vehicle door according to the state of the art and a force diagram in the normal operation of the locking device, FIG. 2*a* a sectional view of the handle according to the invention with an arresting element according to the invention in a normal operation of a locking device, FIG. 2*b* a sectional view of the handle according to the invention with an arresting element according to the invention during a deformation of the vehicle door after an accident, FIG. 3 a perspective view of the handle according to the invention from a perspective in the direction of the vehicle interior, and FIG. 4 a perspective view of the handle according to the invention from another perspective from the vehicle interior into the outer direction.

FIG. 1 shows a common handle 1 according to the state of the art which is likewise called crash-lock. The handle 1 is assembled in locking devices at vehicle doors 100 between an outer 101 and an inner door panel 102 and shall avoid that the door handle 110 is swiveled from a locking position 110*a* into an unlocking position 110*b* in case of an accident and that the vehicle door is opened undesirably. Therefor the common handle 1 is configured with a mass balancing element 10, which is used for securing the door handle 110 due to its inertia force M. The handle 1 comprises a transmission element 14, which is kind of a rocker between the door handle 110 and the mass balancing element 10. The mass balancing element 10 is thereby pivotably mounted about an axis 12 in a way that the transmission element 14 configures the lever of the rocker. This transmission element 14 can transmit the tensile force Z at the door handle 110 in an unlocking position 110*a* opening the door lock to the mass balancing element 10 against its inertia force M. Since the mass balancing element 10 is configured more massive than the door handle 110, the tensile force Z has to be applied at the door handle 110, which increases the inertia force M of the mass balancing element 10 in order to open the door. Further, the common handle 1 comprises a blocking element 20, which blocks the mass balancing element 10 during accelerations I against swiveling into the releasing unlocking position of the door handle. The blocking element 20 is thereby likewise pivotably mounted about an axis 22. In the normal operation the blocking element 20 is not operated and is located in a resting position 20*a*. During accelerations I, which can lead to an opening of the door, due to its inertia force m the blocking element 20 however can be swiveled in the same direction of rotation S like the mass balancing element 10 in case the door handle 110 is turned into the unlocking position 110*a*. Therewith, the blocking element 20 can be transmitted into a blocking position 20*b* according to the mass balancing element 10, in which the blocking element 20 blocks the mass balancing element 10. The accelerations II, which act on the components of the handle 1 in the direction from the outside to the inside can in fact bring the mass balancing element 10 in the unlocking position 10*a* and the blocking element 20 in the resting position 20*a*, however, they act on the door handle 110 into the locking position 110*b* closing the door and are therefore not risky for opening of the door.

During an accident, however, not only accelerations I and II can act to the vehicle door but also impact forces I and II, which can lead to the fact that the door handle 110 is skidded into the unlocking position 110*a* opening the door lock. The mass balancing element 10, which is accelerated in the same direction S in the normal case serves for the fact that the door handle 110 nevertheless remains in its locking position 110*b*. If, however, during an accident the outer 101 and/or the inner door panel 102 are damaged, like for example shown in FIG. 2*b*, the mass balancing element 10 can be undesirably pushed in its unlocking position 10*a*, in which the undesired opening of the door cannot be avoided. The blocking element 20 can thereby likewise be transmitted undesirably in its resting position 20*a* by deformation of the outer 101 and/or the inner door panel 102, in which the mass balancing element 10 cannot be locked.

In case of a strong lateral vehicle impact and a deflection of the vehicle door it can occur that the blocking element 20 can be clamped in the resting position 20*a* and cannot be activated according to its function. In order to avoid this the invention proposes to provide an arresting element 30 for the blocking element 20, which can reliably arrest the blocking element 20 in the blocking position 20*b* during a deformation of the door panel 101, 102 particularly the inner door panel 102, in order to avoid an accident related opening of the door.

Figure 2A:
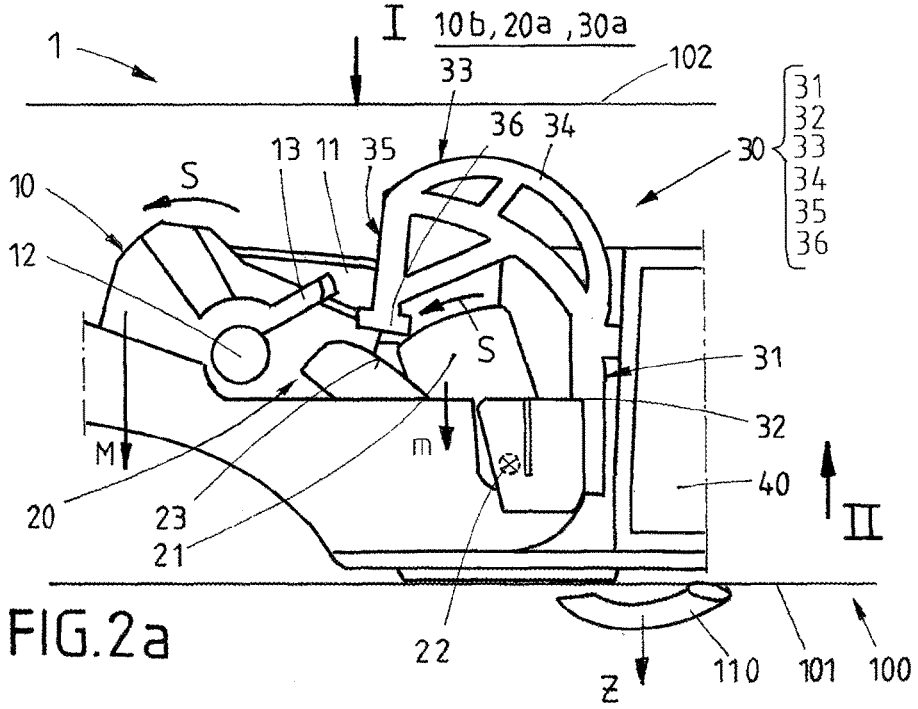
Figure 2B:
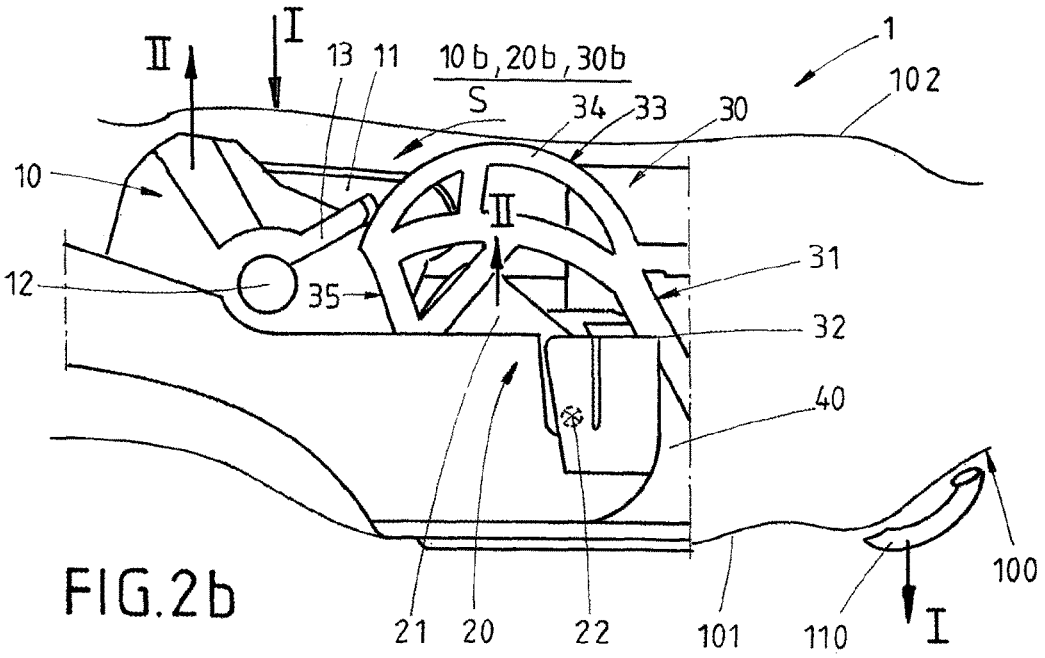

FIGS. 2*a* and 2*b* show an arresting element 30 according to the invention for a blocking element 20 and a handle 1 according to the invention for the locking device of the vehicle door, respectively in the normal operation (see FIG. 2*a*) and in case of a deformation of the vehicle door 100 after an accident (see FIG. 2*b*), respectively.

The arresting element 30 is thereby configured with a fixing area 31 for fixing the arresting element 30 in the locking device, a sensor area 33 for detecting a deformation of the door panel 101, 102 of the vehicle, particularly the inner door panel 102, and an arresting area 35 for arresting the blocking element 20. A first advantage of the arresting element 30 according to the invention is that the arresting element 30 can be re-fitted in existing locking devices without the need to re-assemble the locking device. For this purpose the fixing area 31 is intended, which is configured in a way in order to fix the arresting element 30 in existing locking devices. The arresting element 30 according to the invention further comprises the advantage that the deformation of the vehicle door 100, particularly the inner door panel 102 of the vehicle door 100, can be reliably registered and the blocking element 20 can be arrested in the blocking position 20*b*. The arresting element 30 therewith enables a reliable functionality of the blocking element 20, which can reliably block the mass balancing element 10 during an accident. Therefor, according to the invention a sensor area 33 is intended, which is configured in a way in order to detect the deformation of the inner door panel 102. Further, it is an advantage of the invention that the sensor area 33 is configured in a way that the arresting element 30 can only be controlled by a deformation of the inner door panel 102 in order to arrest the blocking element 20 (see FIG. 2*b*). The arresting element 30 can thereby be moved between a released position 30*a* of FIG. 2*a* and an arresting position 30*b* of FIG. 2*b*. Like it is shown in FIG. 2*a* the blocking element 20 remains further movable in the released position 30*a* of the arresting element 30 relative to the arresting element 30. Like it is shown in FIG. 2*b* the blocking element 20 is arrested in the arresting position 30*b* by the arresting element 30. For arresting the blocking element 20 the arresting element 30 according to the invention comprises an arresting area 35, which can reliably keep the blocking element 20 in the blocking position 20*b* or can push it to the blocking position 20*b* in case the door panel 101, 102 is deformed during an accident.

Like further shown in FIGS. 2*a* and 2*b* the fixing area 31 comprises fixing means 32, which are configured in form of a step in order to fix the arresting element 30 at the mounting element 40 of the locking device in a formfitting and detachable manner. Thereby the arresting element 30 can tilt from the released position 30*a* in the arresting position 30*b* via the step 32. Alternatively, it is however possible that any desired manner of detachable fixations can be used in order to fix the arresting element at existing locking devices like for example a clip, catch, snap or hinge means, preferably a film hinge. Further, it is possible that the fixing means 32 can be an adhesive in order to connect the arresting element 30 with the mounting element 40 in a firmly bonded manner. Further, it is possible that the fixing means 32 are configured in form of a welding seam in order to weld the arresting element 30 to the mounting element 40. Further, it is possible that the fixing area 31 is configured flexible and resilient in order to enable that the arresting element 30 can be absorbed between the released position 30*a* and the blocking position 30*b*. Advantageously, thereby, the arresting element 30 can be movably mounted at the mounting element 40. Likewise it is possible that the arresting element 30 can be an integral part of the mounting element 40.

Further, it is shown in FIGS. 2*a* and 2*b*, that the sensor area 33 comprises a sensor means in form of a curve element 34, which is bent into the direction of the inner door panel 102. The sensor means 34 further enables that the deformation of the inner door panel 102 can be detected by contact. The idea of the invention is thereby that the deformation of the inner door panel 102 is directly transmitted to the arresting element 30, wherein the inner door panel 102 presses at the sensor means 34 and the arresting element 30 can be transmitted in the arresting position 30*b*.

At the edge of the arresting area 35 an arresting means 36 can be configured in form of a widened surface area 36, which presses to a complementary arresting area 23 of the blocking element 20 during the deformation of the inner door panel 102 in order to arrest the blocking element 20. Like it is shown in FIG. 2*b* the sensor means 34 takes up the mechanic deformation energy of the inner door panel 102 and transmits it into a movement of the arresting element 30 from the released position 30*a* in the arresting position 30*b*, wherein a mechanic pressure is performed to the blocking element 20 in order to push the blocking element 20 in the blocking position 20*b* so that the blocking element 20 cannot be deflected in the resting position 20*a*.

Like it is shown in FIG. 2*a* the arresting element 30 is inactive in the normal operation. During accelerations I, which act into the direction toward the outside and lead to an opening of the door, the mass balancing element 10 and the blocking element 20 are likewise in normal operation. Both are analogously loaded in direction of rotation S in which the inertia force M of the mass balancing element 10 predominates the tensile force Z at the door handle 110 and the inertia force m of the blocking element 20 additionally secures the mass balancing element 10. Like it is shown in FIG. 2*b* accelerations II from the outside and door deformations II can lead to the fact that the mass balancing element 10 and the blocking element 20 can be pushed undesirably in the released position 30*a* or resting position 20*b*, wherein the door handle 110 can be already transmitted in the unlocking position 110*a*. The arresting element 30 according to the invention however, provides a simple but secure means, which avoids an undesired scenario by pushing the arresting element 30 in the direction of rotation S from the released position 30*a* and the arresting position 30*b*. In the arresting position 30*b* of FIG. 2*b* the blocking element 20 and therewith likewise the mass balancing element 10 cannot be swiveled in the direction of rotation E so that an undesired opening of the door is avoided.

Figure 3:
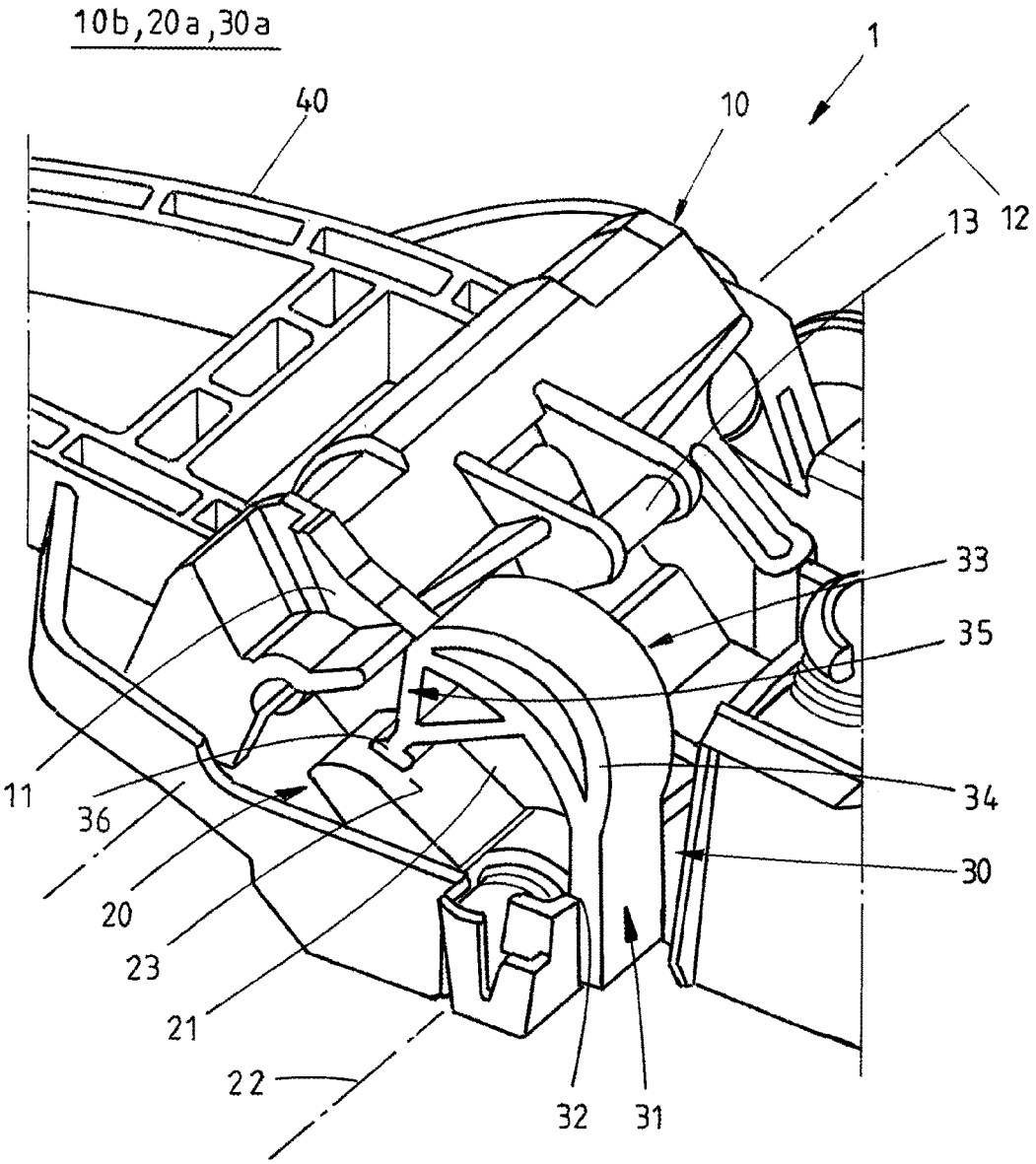
Figure 4:
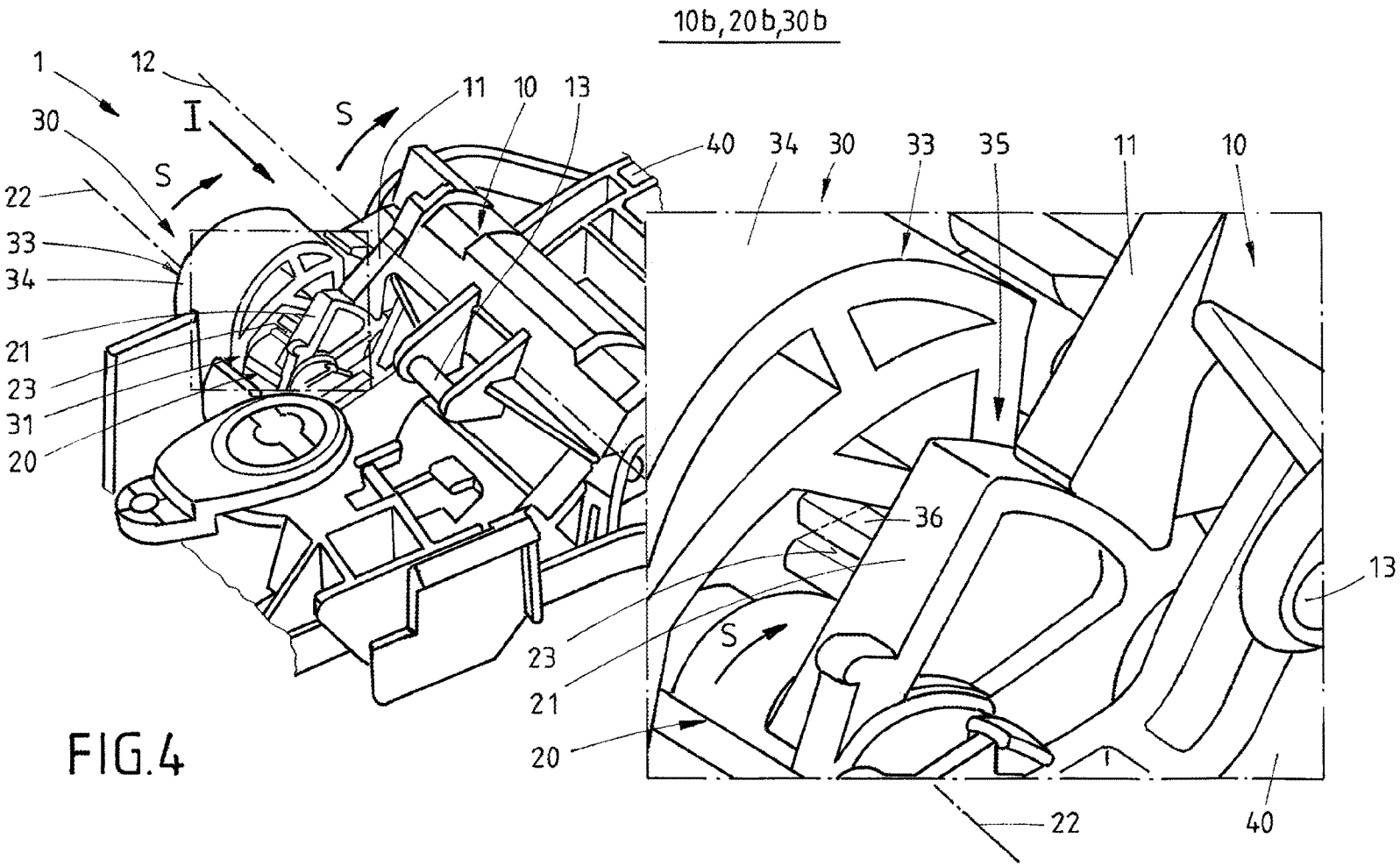

FIGS. 3 and 4 show a handle according to the invention in a perspective view from two different points of view from the outside to the inside (see FIG. 3) and from the inside to the outside (see FIG. 4). The handle 1 thereby comprises a mass balancing element 10, which can be brought into operative connection with the door handle 110, wherein the mass balancing element 10 due to an influence of accelerations I, which act to the door handle 110 during an accident, can avoid an undesired opening of the door due to its inertia force M, a blocking element 20, which can be moved between a resting position 20*a* and a blocking position 20*b*, wherein in the resting position 20*a* the mass balancing element 10 can be movable relative to the blocking element 20 and in the blocking position 20*b*, in which the blocking element 20 can be deflected during an accident due to its inertia force m the blocking element 20 can block the mass balancing element 10. The handle 1 further comprises an arresting element 30 according to the invention, which was previously described in detail according to FIGS. 2*a* and 2*b*. The arresting element 30 can thereby be moved between a released position 30*a* (see FIGS. 2*a* and 3) and an arresting position 30*b* (see FIGS. 2*b* and 4), wherein in the released position 30*a* the blocking element 20 can be relatively movable to the arresting element 30 and in the arresting position 30*b* the arresting element 30 can arrest the blocking element 20. Therewith according to the invention the blocking element 20 is secured so that the blocking element 20 is supported in its blocking function after an accident even during deformation of the door panel 101, 102, particularly the outer door panel 101. The arresting element 30 further enables that, in case the equilibrium of forces between the masses 10, 20 and 110 is disturbed due to mechanic deformations of the door panel 102, 102 like shown sketchy in FIG. 2*b*, the door however remains closed. The idea of the invention is thereby that the arresting element 30 is activated especially by the deformation of the door panel 101, 102, particularly the inner door panel 102, in order to push the blocking element 20 in the blocking position 20*b* in order to keep the mass balancing element 10 blocked in the blocking position 10*b*.

The handle 10 is according to the invention assembled at the mounting element 40, which serves for the assembly of the locking device and for the movable acceptance of the blocking element 20 and the mass balancing element 10. The mounting element 40 thereby comprises not shown areas and sections in order to assemble the locking device at the door between the outer door panel 101 and the inner door panel 102. The object of the handle 1 during an accident is to ensure the security of the passengers, particularly to ensure that the door remains closed, when one of the door panels 101, 102 or even both are deformed. The handle 1 according to the invention further uses the deformation of the door panels 101, 102 in order to control the arresting element 30 in the arresting position 30*b*. The arresting element 30 in the arresting position 30*b* affects the blocking element 20 in the direction of rotation S in the blocking position 20*b*, in which the blocking element 20 blocks the mass balancing element 10 in the locking position 10*b*. Like it is shown in the enlarged section of FIG. 4 and FIG. 2*b* a blocking means 21 of the blocking element 20 is attached at a cam 11 of the mass balancing element 10 and therewith avoids that the mass balancing element 10 can reach the unlocking position 10*a*.

The mass balancing element 10 comprises an operating lever 13, which can be in a connection with the door handle 110 via a transmission element 14 in form of a rocker. The transmission element 14 is not shown in FIGS. 2*a* to 4, it is schematically indicated in FIG. 1. The mass balancing element 10 and the operating lever 13 are firmly connected to one another. In the normal case the operating lever 13 and the transmission element 14 serve for transmitting the tensile force from the door handle 110 to the mass balancing element 10 for opening the door and during accelerations to avoid an adjustment of the mass balancing element 10 in the unlocking position 10*a*.

The mass balancing element is pivotably mounted about an axis 12 and the blocking element is pivotably mounted about an axis 22, wherein the axis 12 and 22 proceed spaced apart and in parallel. Such mountings serve for the fact that the mass balancing element 10 and the blocking element 20 can swivel in the same direction of rotation S or E without inhibiting one another in case of accelerations I or II. At the same time such assemblies serve for the fact that pivotable movements of the mass balancing element 10 from the unlocking position 10*a* in the locking position 10*b* can occur parallelly and undisturbedly from pivotable movements of the blocking element 20 from the resting position 20*a* to the blocking position 20*b*. The movement patterns, which occur during acceleration I, which can act to the door handle 110 in the unlocking position 110*a*, which opens the door, which are indicated in FIGS. 2*a* and 4 with the direction of rotation S. The movement patterns, which occur during opposing accelerations II, which can act to the door handle 110 in a locking position 110*b* closing the door are avoided according to FIGS. 2*b* and 4. Thereby, the mass balancing element 10 can be re-swiveled in its unlocking position 10*a* and the blocking element 20 in its resting position, undesirably, however no danger occurs that the door handle 110 is swiveled to the outside in the unlocking position 110*a*.

The previous description of the embodiments describes the present invention only within the scope of examples. Naturally, single features of the embodiments as far as technical meaningful can be further developed without leaving the scope of the present invention.

REFERENCE LIST

1 Handle
10 Mass balancing element
10*a* Unlocking position
10*b* Locking position
11 Cam of the mass balancing element
12 Rotation axis of the mass balancing element
13 Operating lever
14 Transmission element
20 Blocking element
20*a* Resting position
20*b* Blocking position
21 Blocking means of the blocking element
22 Rotation axis of the blocking element
23 Arresting area of the blocking element
30 Arresting element
30*a* Released position of the arresting element
30*b* Arresting position of the arresting element
31 Fixing area of the arresting element
32 Fixing means of the arresting element
33 Sensor area of the arresting element
34 Sensor means of the arresting element
35 Arresting area of the arresting element
36 Arresting means of the arresting element
40 Mounting element
100 Vehicle door
101 Outer door panel
102 Inner door panel
110 Door handle
110*a* Unlocking position
110*b* Locking position
I Acceleration from the internal area of the vehicle in the direction of the door handle in case of deformation of the outer door panel
II Acceleration from the external area of the vehicle in the direction of the internal area in case of the deformation of the inner door panel
E Direction of rotation for unlocking the door, unlocking the door handle 110, blocking of the mass balancing element 10, arresting of the blocking element 20
S Direction of rotation for locking the door, locking the door handle 110, unlocking the mass balancing element 10, releasing the blocking element 20
m Inertia force for the blocking element during acceleration I
M Inertia force of the mass balancing element during acceleration I
Z Tensile force at the door handle during acceleration I

What is claimed is:

1. An arresting element for a blocking element of a locking device of a vehicle door, comprising:

a mass balancing element adapted to be brought into an operative connection with a door handle, wherein the mass balancing element due to an influence of accelerations, which act to the door handle during an accident, avoids an undesired opening of the vehicle door due to its inertia force; and a blocking element adapted to be moved between a resting position and a blocking position, wherein in the resting position the mass balancing element is relatively movable to the blocking element, and in the blocking position, in which the blocking element is deflectable during an accident due to its inertia force the blocking element blocks the mass balancing element, wherein the arresting element is movable between a released position and an arresting position, wherein in the released position the blocking element is movable relative to the arresting element and in the arresting position the arresting element arrest the blocking element, and wherein the arresting element is provided with a fixing area for fixing the arresting element at the locking device;

a sensor area for detecting a deformation of a door panel of the vehicle, which is directed towards the interior of the vehicle; and an arresting area for arresting the blocking element.

2. The arresting element according to claim 1, wherein the fixing area of the arresting element comprises a fixing section in form of a step, in order to assemble the arresting element at a mounting element of the locking device in a form and/or force fitting manner.

3. The arresting element according to claim 1, wherein the sensor area of the arresting element comprises a sensor section in form of a curved area on the arresting element which is curved in the direction to an inner door panel of the vehicle, so that after assembly of the arresting element at the locking device the arresting element pivots about a portion of the blocking element, adjacent the fixing area, toward an outer door panel, due to impact from the inner door panel on the sensor area, which faces the inner door panel, in order to detect a deformation of the inner door panel by contact.

4. The arresting element according to claim 1, wherein the arresting area of the arresting element comprises an arresting section which can be brought in an operative connection with the complementary arresting area of the blocking element during a deformation of an inner door panel in order to arrest the blocking element.

5. The arresting according to claim 2, wherein the mounting element is assembled at the locking device and at which the blocking element and the mass balancing element can be movably assembled.

6. The arresting according to claim 1, wherein the arresting element can be transmitted in the arresting position during an accident by deformation of a door panel which is directed to the interior of the vehicle.

7. The arresting according to claim 2, wherein the arresting element can be assembled at the mounting element in a form and/or force fitting and/or firmly bonded manner.

8. The arresting according to claim 1, wherein the mass balancing element comprises an operating lever, with which the door handle is in connection.

9. The arresting according to claim 8, wherein the mass balancing element and the operating lever are connected to one another.

10. The arresting according to claim 1, wherein the mass balancing element is mounted pivotably about an axis and/or spring loaded in a locking position securing the door handle.

11. The arresting according to claim 1, wherein the blocking element is pivotably mounted about an axis and/or spring loaded in the released position.

12. The arresting according to claim 10, wherein the axis of the mass balancing element is assembled spaced and in parallel to the axis of the blocking element.

13. The arresting according to claim 1, wherein the mass balancing element and the blocking element are pivotably mounted at the mounting element in a way that during accelerations both can be swiveled in the same direction of rotation.

14. The arresting according to claim 1, wherein the blocking element comprises a blocking means, which can be brought in an operative connection with a complementary cam of the mass balancing element in the blocking position of the blocking element in order to block the mass balancing element.

* * * * *